US009090844B2

(12) United States Patent
Fingerhut et al.

(10) Patent No.: US 9,090,844 B2
(45) Date of Patent: Jul. 28, 2015

(54) METHOD FOR PRODUCING MOLDINGS

(75) Inventors: Wilhelm Fingerhut, Leonding (AT); Hado Heckmann, Linz (AT); Leopold Werner Kepplinger, Leonding (AT); Kurt Wieder, Schwertberg (AT); Johann Wurm, Bad Zell (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 0 days.

(21) Appl. No.: 12/598,973

(22) PCT Filed: Apr. 28, 2008

(86) PCT No.: PCT/EP2008/003418

§ 371 (c)(1),
(2), (4) Date: Nov. 10, 2009

(87) PCT Pub. No.: WO2008/138478

PCT Pub. Date: Nov. 20, 2008

(65) Prior Publication Data

US 2010/0133723 A1 Jun. 3, 2010

(30) Foreign Application Priority Data

May 9, 2007 (AT) ..... 712/2007

(51) Int. Cl.

| | |
|---|---|
| ***C10L 5/16*** | (2006.01) |
| ***C10L 5/22*** | (2006.01) |
| ***C10L 5/36*** | (2006.01) |

(52) U.S. Cl.

CPC ... *C10L 5/16* (2013.01); *C10L 5/22* (2013.01); *C10L 5/361* (2013.01)

(58) Field of Classification Search

CPC ..... C10L 5/16
USPC ..... 264/109
See application file for complete search history.

(56) References Cited

U.S. PATENT DOCUMENTS

| | | | | |
|---|---|---|---|---|
| 3,140,241 | A | 7/1964 | Work et al. | |
| 4,142,941 | A | 3/1979 | Weber et al. | |
| 4,995,904 | A | 2/1991 | Hauk | |
| 5,078,927 | A | 1/1992 | Lask | 264/29.3 |
| 5,262,043 | A | 11/1993 | Boenigk et al. | 208/41 |
| 5,264,007 | A | 11/1993 | Lask | 44/564 |

(Continued)

FOREIGN PATENT DOCUMENTS

| | | |
|---|---|---|
| AT | 376241 | 10/1984 |
| DE | 2220479 A | 4/1972 |

(Continued)

OTHER PUBLICATIONS

International Search Report dated Jan. 12, 2009, issued in corresponding international application No. PCT/EP2008/003418.

(Continued)

*Primary Examiner* — Larry Thrower
(74) *Attorney, Agent, or Firm* — Ostrolenk Faber LLP

(57) ABSTRACT

A method for producing moldings, in particular briquettes, from fine-grained to medium-grained mixed material using organic binders. In a first stage, the mixed material is heated to a temperature necessary for the molding operation. In a second, atmospherically separate stage, mixing of the mixed material with binder is performed, as well as downstream steps of the process. The method allows hazardous emissions to be avoided.

26 Claims, 2 Drawing Sheets

(56) References Cited

U.S. PATENT DOCUMENTS

| | | | | |
|---|---|---|---|---|
| 6,332,911 | B1 * | 12/2001 | Schrey et al. | 75/492 |
| 7,846,301 | B2 | 12/2010 | Katou et al. | 201/3 |

FOREIGN PATENT DOCUMENTS

| | | | |
|---|---|---|---|
| DE | 1421258 | B1 | 9/1972 |
| DE | 2407780 | A1 | 8/1975 |
| DE | 2640787 | A1 | 3/1978 |
| DE | 224331 | A1 | 7/1985 |
| DE | 3530240 | A1 | 5/1986 |
| EP | 0 024 634 | A1 | 3/1981 |
| EP | 0138100 | A | 4/1985 |
| EP | 0 315 825 | A1 | 5/1989 |
| EP | 0409014 | | 1/1991 |
| JP | 56139584 | A | 10/1981 |
| JP | 2270922 | | 11/1990 |
| JP | 5065487 | A | 3/1993 |
| JP | 2001-279335 | A | 10/2001 |
| JP | 2004-538339 | | 12/2004 |
| KR | 10-0551608 | | 2/2006 |
| RU | 2016048 | | 7/1994 |
| SU | 1399334 | A | 5/1988 |
| SU | 1834899 | | 8/1993 |
| WO | WO 99/01583 | A | 1/1999 |
| WO | WO 02/05557 | | 1/2002 |
| WO | WO 02/50219 | A1 | 6/2002 |
| WO | WO 02/079357 | | 10/2002 |
| WO | WO 2005/071119 | A1 | 8/2005 |
| WO | WO 2006/121213 | | 11/2006 |

OTHER PUBLICATIONS

Russian Federation Decision Regarding Grant of a Patent, dated Feb. 28, 2012, issued in corresponding Russian Patent Application No. 2009145525/05 (064918), filed Apr. 28, 2008, 6 pages. English translation 5 pages. Total 11 pages.

English translation of Japanese Office Action, dated Jan. 29, 2013, issued in corresponding Japanese Patent Application No. 2010-506831. Total 5 pages.

* cited by examiner

METHOD FOR PRODUCING MOLDINGS

CROSS-REFERENCE TO RELATED APPLICATIONS

The present application is a 35 U.S.C. §§371 national phase conversion of PCT/EP2008/003418, filed Apr. 28, 2008, which claims priority of Austrian Application No. A712/2007, filed May 9, 2007, incorporated by reference herein. The PCT International Application was published in the English language.

BACKGROUND OF THE INVENTION

The invention relates to a method for producing moldings, in particular briquettes, from fine-grained to medium-grained mixed material using organic binders.

While the production of pig iron in blast furnaces with coke uses an artificially produced lumpy carbon carrier as an energy source, reducing means and a supporting framework of a fixed bed, the smelting reduction process based on the COREX®/FINEX® method uses lumpy coal in this function. In the case of commercially available coals, a certain proportion is too fine in terms of grain size to perform the function of a supporting framework in the gassed-through upper part of the fixed bed and in the lower part of the fixed bed that is penetrated by the liquid pig iron and liquid slag. This sub-fraction is therefore separated from the lumpy coal used in the smelting reduction process by screening, it being possible for the screening to be performed before and/or after drying of the coal. The dried sub-fraction of the coal can be transformed into a lumpy form for example by means of briquetting, and consequently made available for being used in a way equivalent to lumpy coal in the smelting reduction process. To obtain a grain size that is suitable for the briquetting, it may be necessary for the screened undersize or coal intended for the briquetting optionally to pass through a crusher before the actual briquetting can be performed. Depending on the type of binder used, the briquettes discharged from the briquetting press usually require subsequent treatment in the form of cooling or heating or a certain dwell time to develop strengths. After that, they are suitable for transporting and bunkering and can be used in a smelting reduction process based on the method described.

The conventional procedure for the briquetting of hard coals with organic binders, such as for example coal-tar pitch (or asphalt bitumen), essentially comprises that the coal is prepared with respect to the grain size and moisture content, followed by the mixing in of a binder with simultaneous use of live steam, to set the required mixing temperature. The mixing is carried out by kneading while feeding in live steam, for instance at temperatures of 90-100° C. The vapor is removed from the mixture in order to reduce the moisture content, with vapors and gasses being drawn off. In a subsequent step, the production of the briquettes is performed.

A particular disadvantage here is that, during the vapor removal, organic pollutants are discharged with the vapor, which is also known as the stripping effect. In the case of coal-tar pitch as the organic binder, the organic pollutants contain compounds that are classified as carcinogenic. On account of their hazardous potential for the operating and maintenance personnel, the use of coal-tar pitch as the binder is greatly restricted or prohibited in Europe (for example TRGS 551 in Germany). In hard coal briquetting (briquettes for household coal), coal-tar pitch has therefore been replaced by asphalt bitumen or molasses.

Unlike in the case of household coal, coal briquettes for use in smelting reduction processes must have not only mechanical properties but also sufficient metallurgical properties, such as for example thermal shock resistance, thermomechanical resistance and low reactivity to $CO_2$.

However, on account of the high alkali content of commercially available grades and the addition of lime that is necessary in this case during the briquetting, prior-art briquettes bound with molasses (such as for example according to WO02/50219, WO/020555 and WO 2005/071119) are extremely unstable with respect to hot CO2 gas. Use of relatively great proportions of such briquettes in a smelting reduction process must therefore be compensated by correspondingly great proportions of lumpy coal with good metallurgical properties and/or metallurgical coke.

Although briquettes produced with asphalt bitumen as the binder generally meet the metallurgical requirements of a smelting reduction process, that is to say they take a mid-range position between briquettes bound with molasses and briquettes bound with coal-tar pitch with respect to their reactivity behavior, this variant of the method is currently not attractive because of high crude oil prices.

In countries with high coking coal production in which coal-tar pitch is available relatively inexpensively but crude oil and molasses are imported goods, there are economic advantages to a particular extent in favor of using coal-tar pitch as the binder.

It must be taken into account in this respect that the briquettes bound with coal-tar pitch have the potential for dispensing with the need for the addition of relatively expensive components, such as metallurgical coke and/or semicoking coal or else coking coal for mixing charge coal.

On the other hand, increased environmental and safety awareness has recently become established even in the developing industrial countries of Asia, with European standards being adapted. In such countries, too, approval for the operation of a briquetting plant with coal-tar pitch as the binder is only possible if the escape of organic pollutants is prevented with certainty.

Prevention of emissions of organic pollutants means that the plant must be of such a configuration that it is largely encapsulated with respect to the environment. Inside the plant there must be negative pressure with respect to the surroundings. The amounts of gas extracted to maintain the negative pressure must pass through wet or dry dedusting and the dedusted gases freed of organic remains by way of subsequent thermal treatment. In the case of wet dedusting, the waste water must undergo appropriate treatment. The filter residues of the waste water purification must undergo proper disposal. However, this is not cost-effectively achievable by conventional methods, because in this case considerable amounts of contaminated condensates or waste water would be produced from wet dedusting facilities.

SUMMARY OF THE INVENTION

It is therefore an object of the present invention to provide a method for producing moldings that excludes any hazard presented by organic materials and nevertheless allows a large number of binders.

On account of the separation of the method step of heating the lumpy mixed material from the further mixing with a binder, the outgassing, and consequently the contamination of the vapors by organic, harmful substances, can be avoided, so that complex and expensive waste gas treatments also become unnecessary.

To be able to realize a method for producing moldings, such as for example briquettes, in particular with organic binders, that is in compliance with current environmental standards, it is necessary in particular to avoid emissions of water vapor charged with organic substances or pollutants or contaminated waste water produced when said water vapor condenses.

This is ensured by separating the method into two method stages that are largely isolated from each other. In the first stage, the mixed material is heated without any additional binder, so that, if vapors or condensates are thereby emitted into the surroundings, they are free of any contamination from organic pollutants from the binder.

According to a particular refinement of the method according to the invention, in the second stage, the temperature of the mixed material and of the binder is kept largely constant during the mixing. On account of the previous heating, it is only necessary to compensate for minor temperature losses.

According to a first variant of the method according to the invention, the binder, or at least a binder component, is heated before the mixing, in particular to a temperature above the softening point of the binder or the binder component. This ensures that homogeneous mixing of the mixed material with a binder is achieved.

The heating of the mixed material is performed in the first stage to a temperature of 60 to 140° C., in particular 80 to 100° C. Consequently, the temperature can be adapted to the requirements of the molding operation.

According to a particular refinement of the method according to the invention, the binder, or at least a binder component, is thermoplastic. Thermoplastic behavior has the effect that the binder thermally softens. This makes easier mixing possible.

One possible variant of the method provides that, in a treatment stage following the second stage, the moldings are cooled to a temperature below the softening point of the binder, in particular below 60° C., which makes transportation and storage of the moldings possible. On account of the restricted mechanical strength at high temperatures, cooling is meaningful to minimize the proportion of damaged and bunkered moldings.

According to a special variant of the method according to the invention, the heating is performed in the first stage by indirect heating by means of a liquid or gaseous heating medium, in particular steam, process gas or flue gas. This has the advantage that the mixed material to be heated does not come into contact with the heating medium, the latent heat can be used for heating without condensates being introduced into the mixed material, and consequently a desired moisture content can be set. The energy exchange takes place in this case on the principle of a heat exchanger.

According to an alternative variant of the method according to the invention, the heating is performed in the first stage by direct heating by means of hot gas, in particular flue gas or flue gas/air mixtures, the hot gas being passed through the mixed material, in particular on the countercurrent principle. The direct heating by means of hot gases, with hot flue gases that are present in the operation of a metallurgical plant being used, makes it possible to use an existing energy source and consequently makes low-energy costs possible.

According to an advantageous variant of the method according to the invention, the heating is performed in the first stage in at least two steps. The separation into a number of steps means that the extraction of moisture and vapors is even more possible.

According to a further advantageous variant of the method according to the invention, hot steam is added in the first and/or second step for heating the mixed material. Consequently, setting the required temperature is also possible above the boiling point of the water in the downstream steps of the process.

An advantageous variant of the method according to the invention provides that the heated mixed material is buffer-stored before its further processing, for further isolation of downstream steps of the process in the first and/or second stage. Consequently, the stages can be operated more easily and, even in the event of disturbances occurring in one of the two stages, the other stage can continue to be operated.

According to an advantageous variant of the method according to the invention, after heating of the mixed material in the first stage, gaseous substances and vapors that are present are drawn off and precipitated in a condenser. The measure also allows contaminated mixed material to be reliably processed, it being possible for harmful emissions to be avoided. The drawn-off gaseous substances or the hydrogen are not contaminated by organic impurities.

The drawn-off gaseous substances and vapors advantageously undergo wet dedusting before they are discharged into the surroundings, in order in this way to eliminate harmful emissions. Since these substances and vapors, such as for example the drawn-off water vapor or the flue gas/air mixture used for heating the material, are not contaminated with organic impurities, they can be easily treated and dust emissions prevented.

According to the invention, the second stage takes place under a pressure that is lower than the pressure in the first stage and/or the surrounding pressure. To rule out transfer of the organic contamination to the first stage or to the surroundings, it is kept at a slight negative pressure with respect to the first section and the surroundings.

According to a variant of the method according to the invention, the heated mixed material and the binder or binders are introduced into a mixer in a metered manner, the addition of binder taking place in dependence on the grain size, the amount of mixed material and the strength properties of the moldings. The strength properties are characterized by the compressive strength and the shatter resistance. Shatter resistance is to be understood as a property determined by a standardized test in which the rupture behavior of the item under test is determined on the basis of a free fall. Adapting the amount of binder allows the moldability and the strength properties of the moldings to be specifically controlled. Buffer storage of the heated mixed material before the addition of the binder is possible if need be.

According to the invention, kneading treatment, optionally with the addition of live steam, is performed after the mixing of the heated mixed material with the binder. The kneading treatment produces a homogeneous and dense mixture, so that undisturbed further processing of the mixture is possible. Live steam may be added if need be to set the moisture content. Instead of live steam, it is also possible to use saturated steam.

According to a variant of the method according to the invention, the mixture of heated mixed material and binder is molded in a press into moldings, in particular the mixture is briquetted. The shaping can be chosen in accordance with the requirements of the further use of the moldings, the requirements being defined for example by the metallurgical process in which the moldings are used.

A variant of the method according to the invention provides that vapors produced during the mixing and/or during the kneading and/or during the pressing are extracted and, optionally with the addition of a fuel gas, are burned in a burner at temperatures greater than 600° C., in particular greater than 850° C. The combustion brings about a conversion of the vapors into harmless waste gases, which can be emitted.

According to the invention, the vapors undergo intermediate heating and/or subsequent dry dedusting on their way to the burner. By these measures, condensates in the lines can be avoided, eliminating damage by corrosion. The dedusting makes a clean, dust-free waste gas possible, and undisturbed combustion. The heating may be performed indirectly or directly, it being optionally possible to use the energy of the flue gas from a subsequent combustion.

The invention further provides that the vapors pass through a bulk material filter on their way to the burner. Bulk material filters allow low-cost cleaning of the vapors. The bulk material filter may optionally be omitted if the intermediate heating, dry dedusting and subsequent combustion are performed at a location near the molding device. This has the advantage that deposits in the lines between the molding device and the subsequent combustion are avoided.

According to the invention, a sub-fraction of the mixed material and/or activated carbon and/or petroleum coke and/or coke breeze is used as the filtering medium. Consequently, very low-cost filtering media that can easily be further processed in a metallurgical process are available.

A particularly advantageous refinement of the method according to the invention provides that the heat released in the combustion is fed to the first stage for indirect and/or direct heating. In the case of indirect heating, the mixed material to be heated is thereby heated indirectly via contact areas, which in turn are heated by the hot combustion gas, so that the principle of a heat exchanger is implemented. Indirect heating is performed in particular in the first heating step. In the case of direct heating, hot combustion gas is directly in contact with the mixed material to be heated. This can be used in both heating steps. By utilizing the heat, a particularly energy-efficient method can be ensured.

The invention provides that fragments that are produced in the operation of molding the moldings are added to the mixture of heated mixed material and binder. Fragments in the molding operation can consequently be returned to the molding operation in a low-cost manner, so that losses are kept low.

According to a variant of the invention, the fine-grained to medium-grained mixed material consists at least partly of substances or mixtures of substances that occur or are used for example in pig iron production or in steel production, in particular coal, activated carbon, coke breeze, petroleum coke, additives, slurries, dusts, filter cakes or carbon-containing gasification media. Such substances are produced in large amounts, representing materials of value that can be returned to metallurgical processes. This allows waste to be reduced and costs to be saved.

According to one possible variant of the method according to the invention, the fine-grained to medium-grained mixed material has on average grain sizes of 0.01 to 5 mm, in particular 1 mm. This grain size range has proven in practice to allow the best molding.

According to a particularly advantageous variant of the method according to the invention, the organic binder at least partly comprises coal tar or coal-tar pitch. These binders are available at very low cost and can be processed by the method according to the invention without risks to the environment or personnel.

According to a particular variant of the method according to the invention, the binder cures as such, or in conjunction with additives, in the second stage or in an optional treatment stage following on after the second stage, by heating, and is optionally passed on subsequently for cooling. This particular binder cures by the thermal treatment or by heating, so that no softening occurs even in the case of re-heating.

Moldings produced by the methods contain additives to increase the strength, so that the moldings undergo a conversion into a semicoke during and/or after heating in a subsequent process, so that, as a consequence of this, the latter has high mechanical strength and/or high resistance to attacks by hot $CO_2$-containing gases. This high resistance to mechanical loading, but also to attacks by $CO_2$-containing gases, offers a great advantage when the moldings are used in metallurgical processes. Coking coal or petroleum coke may be used for example as additives.

The invention is described in more detail by way of example and without any restrictive effect on the basis of an exemplary embodiment and the following figures.

DESCRIPTION OF PREFERRED EMBODIMENTS

Figure 1:
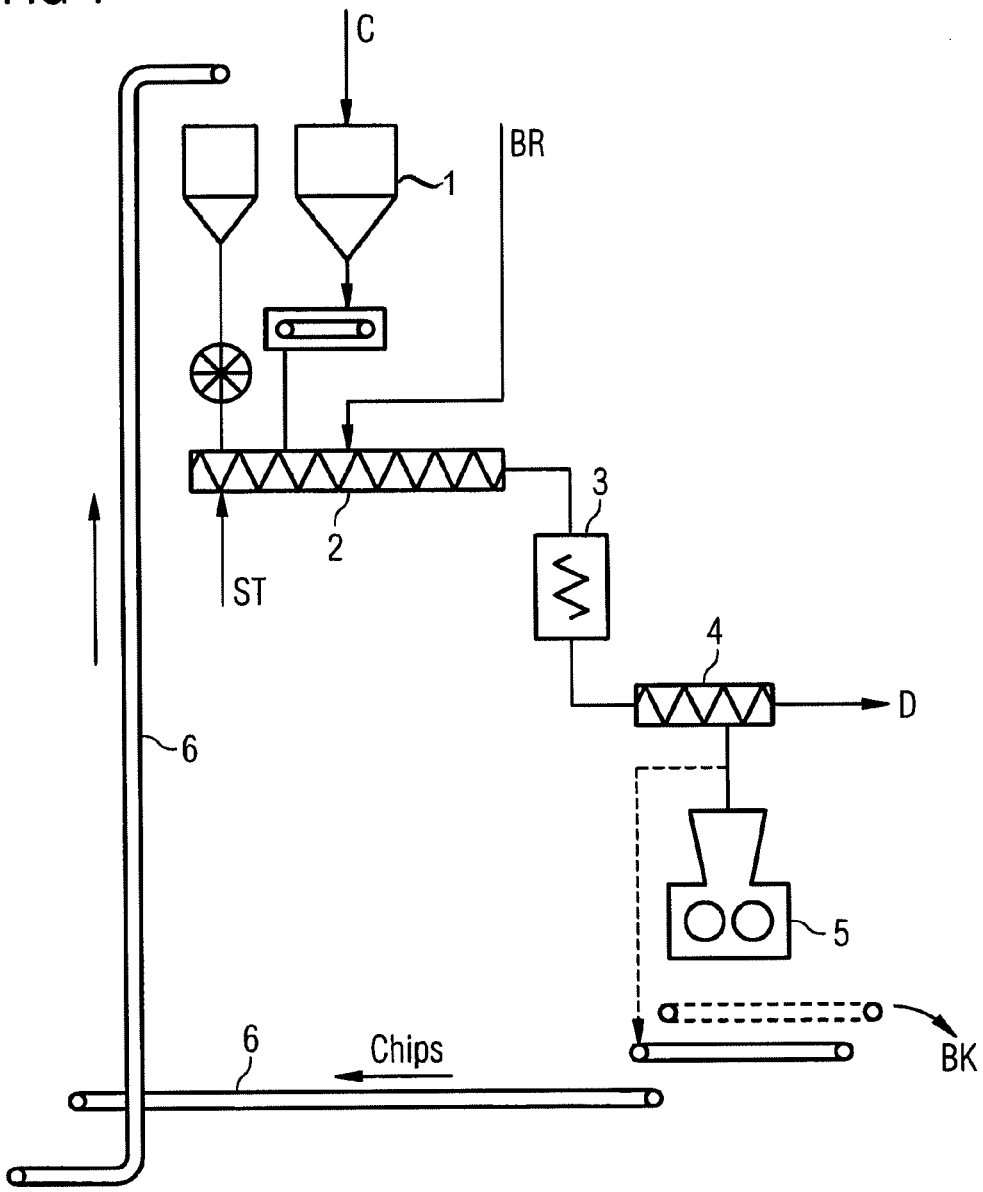
FIG. 1 shows a method according to the prior art.

According to FIG. 1, the coal (C) from a bunker 1 is mixed in a mixer 2 together with a binder (BR) and heated, steam (ST) being introduced into the mixer 2 for heating. In a downstream kneader 3, the substances are intimately mixed, vapors (D) that are produced being drawn off from a mixer 4. The mass is then subsequently pressed in a briquetting plant 5 into briquettes and the briquettes (BK) are discharged. Fragments (chips) thereby produced are returned by means of conveying devices 6.

Figure 2:
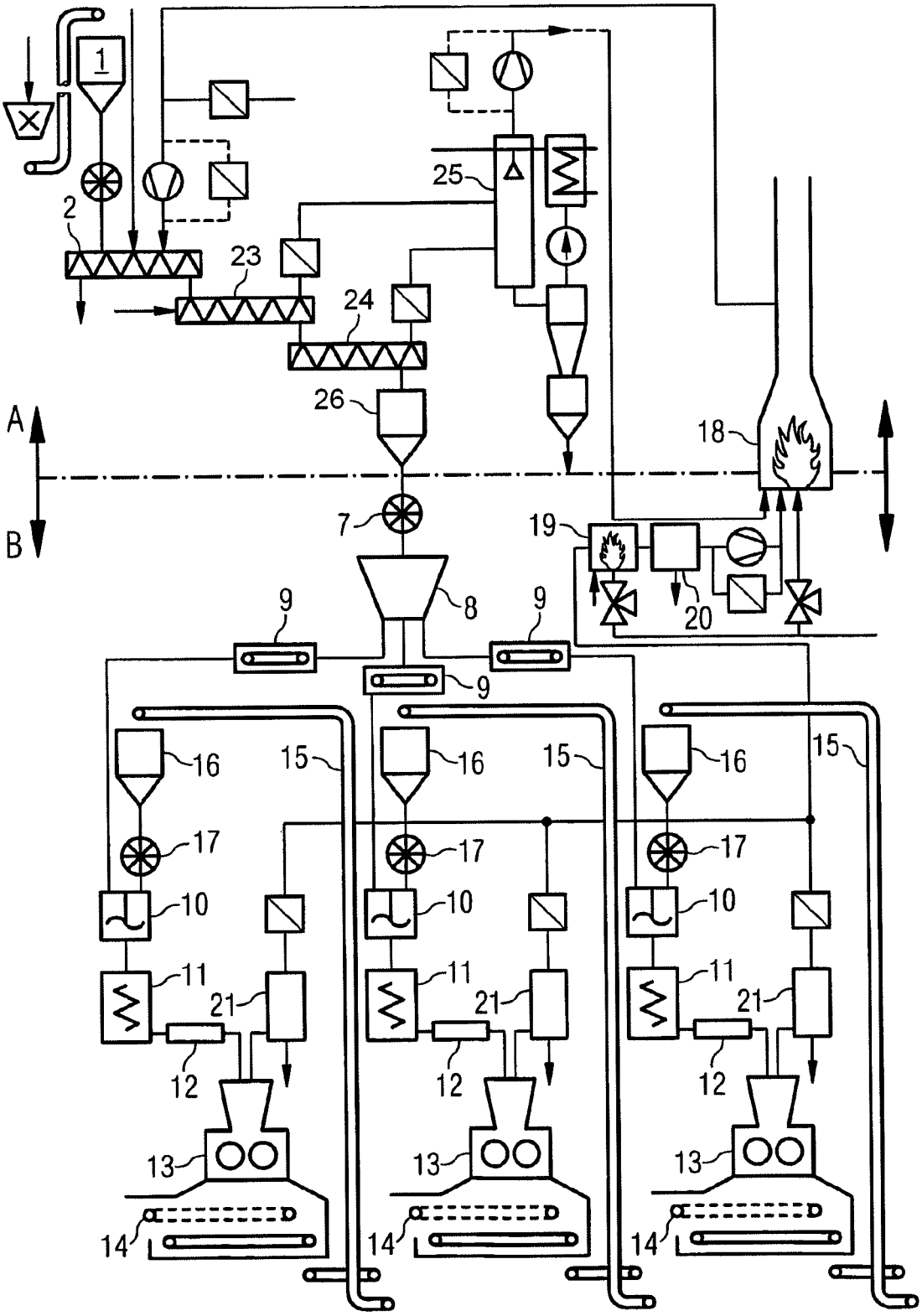
FIG. 2 shows a method according to the invention.

According to FIG. 2, in the first stage A, the grainy mixed material, such as for example coal, optionally prepared by a crusher, is charged into a bunker 1 and heated up to the temperature necessary for the mixing operation even before the admixing of organic binder in two steps, in the heated mixers 2 and 23.

The efficiency of the method can be increased by the grainy mixed material being already preheated, for example on the basis of upstream drying of the coal, when it is charged into the bunker 1.

In a first step, the coal is heated up indirectly with steam and/or directly with flue gas or a flue gas/air mixture in a heated mixer 2, the countercurrent principle preferably being realized.

In a second step, a treatment of the grainy mixed material with superheated steam may be performed in a heated mixer 23, to the extent necessary for setting the required temperature and/or the required moisture content in downstream steps of the process.

Excess vapors are drawn off at the outlet of the heated mixer 23 and at the outlet of an optional vapor-removing screw 24 and precipitated in a condenser 25. After prior separation of suspended coal particles, the condensate uncontaminated by organic pollutants may optionally be fed to an industrial water circulation system. The heated lumpy mixed material is also referred to as conditioned mixed material, or in the case of coal as conditioned coal, and is buffer-stored in a bunker 22.

The second stage B is represented by three parallel lines. These are separated from the first stage by a cellular wheel feeder 7 and a bunker 8 for storage. The arrangement allows the setting of the desired negative pressure in the second stage in relation to the first stage and in relation to the surroundings.

At the outlet of the bunker 8, the conditioned, grainy mixed material is divided between the lines by means of metering conveyor balances 9. In the individual lines, first the admixing of the binder is performed in a mixer 10. In the subsequent treatment in a kneader 11, live steam, preferably saturated steam, is fed in only to the extent necessary to set the desired wetting of the surface of the mixed material. There is no vapor removal before the actual shaping, which may be briquetting.

The screw 12 at the discharge of the kneader 11 merely feeds the finished charge mixture to the press 13, in which the shaping of the moldings is performed. At the discharge from the press, the moldings are separated from fragments that may be produced during the shaping by means of a screening belt 14. The fragments, also referred to as chips, are returned to the mixer 10 by means of a steeply inclined conveyor 15. In a preferred embodiment of the method, the moldings produced in this manner are sent for cooling according to the prior art, in order thereby to ensure curing of the moldings. The cooling may take place in the form of natural, free convection in a free atmosphere or by means of a special device with the assistance of flowing air and/or water, with air as such or air in conjunction with a wetting of the moldings with water and the evaporation thereby initiated and/or the water itself serving as the cooling medium.

To maintain the pressure gradient, a charging bunker 16 with a cellular wheel feeder 17 is interposed. The press overflow to a transporting-away device for the fragments (chips belt) that is necessary to compensate for fluctuations in production is not represented in FIG. 2 for reasons of space. This press overflow must likewise be protected by a cellular wheel feeder, in order to avoid short-circuit flows, and consequently the buildup of a negative pressure in the system.

The extraction to maintain the negative pressure in the second stage takes place with preference at the material inlet to the press 13, in which the shaping of the molding is performed. Optionally, further extractions may be provided at the inlets of the mixer 10 and the kneader 11. The extracted vapor/infiltrated-air mixture is burned in a burner 18 together with a fuel gas at temperatures above 800° C. Under these conditions, organic substances are converted completely into harmless compounds, which escape with the flue gas into the surroundings via a chimney. To protect the lines through which the contaminated vapor/infiltrated-air mixture flows and the suction fan from dust and condensate deposits, intermediate heating 19 is carried out and a dust filter 20 arranged downstream. The deposited dust is returned to the shaping process. In addition, a bulk material filter 21 may be arranged upstream as the first cleaning stage. A medium-grained subfraction of briquetting coal, an activated carbon or coke breeze is suitable here in particular as the filtering medium. With appropriate arrangement of the filter, the filtering medium contaminated with organic components may alternatively be fed via the mixer, the kneader, the press charge or indirectly via the chips belt to the shaping process, so that there is no need for separate disposal. To avoid condensates in the suction lines, instead of the bulk material filter each briquetting line may also be assigned a unit comprising a bulk material filter, intermediate heating and dry dedusting.

A particularly advantageous variant of the method comprises using the heat that is released in the burner directly, for example by making the hot flue gas or flue-gas/air mixture pass through the grainy mixed material in the second mixer 23, or indirectly via a heat exchanger in the first heated mixer 2.

Apart from largely uncontaminated condensates and slurries that are produced in the first stage and a likewise uncontaminated flue gas, no byproducts occur in the case of the method according to the invention as provided by the exemplary embodiment.

The interfaces of the negative pressure system of the second stage with the surroundings are disposed outside the building in which the method proceeds. The return of the fragments (chips) is encapsulated; the persons employed in this area cannot in any way come into contact with vapor emissions of the briquettes discharged from the press or from the chips.

The invention claimed is:

1. A method for producing moldings from fine-grained to medium-grained mixed material using organic binders, comprising a first stage of heating the mixed material to a temperature necessary for a molding operation and a second stage of mixing the mixed material with binder, and then downstream steps of a process of molding, wherein the second stage is atmospherically separate, and under a pressure that is lower than the pressure in the first stage and/or a pressure outside a building in which the method is performed, wherein the fine-grained to medium-grained mixed material has on average grain sizes of 0.01 to 5 mm, the second stage of mixing the mixed material with binder being performed after the first stage of heating the mixed material to the temperature necessary for the molding operation is completed.

2. The method as claimed in claim 1, further comprising in the second stage, keeping the temperature of the mixed material and of the binder largely constant during the mixing.

3. The method as claimed in claim 1, wherein the binder, or at least a binder component, is heated before the mixing to a temperature above a softening point of the binder or the binder component which is heated.

4. The method as claimed in claim 3, wherein the binder, or at least the binder component, is thermoplastic.

5. The method as claimed in claim 1, further comprising a treatment stage following the second stage and comprising cooling the moldings to a temperature below the softening point of the binder.

6. The method as claimed in claim 1, wherein the first stage heating is performed by indirect heating by a liquid or gaseous heating medium.

7. The method as claimed in claim 1, wherein the first stage heating is performed by direct heating by means of hot gas, the hot gas being passed through the mixed material in a countercurrent principle.

8. The method as claimed in claim 1, wherein the first stage heating is performed in at least two steps.

9. The method as claimed in claim 8, further comprising adding hot steam in one of the at least two steps for heating the mixed material.

10. The method as claimed in claim 1, further comprising buffer storing the heated mixed material before further processing thereof in the downstream steps after the buffering, for further isolation of the downstream steps of the process in the first and/or second stage.

11. The method as claimed in claim 1, further comprising, after heating of the mixed material in the first stage, drawing off gaseous substances and vapors that are present and precipitating the drawn off gaseous substances and vapors in a condenser.

12. The method as claimed in claim 11, further comprising wet dedusting of the gaseous substances and vapors and then discharging the gaseous substances and vapors into the surroundings.

13. The method as claimed in claim 10, further comprising introducing the heated mixed material and the binder into a mixer in a metered manner, selecting the amount of binder in dependence on the grain size, the amount of mixed material and the strength properties of the moldings.

14. The method as claimed in claim 1, further comprising, after the mixing of the heated mixed material with the binder, kneading the mixed material and the binder, optionally with the addition of live steam.

15. The method as claimed in claim 1, further comprising molding the mixture of heated mixed material and binder in a press into moldings.

16. The method as claimed in claim 15, further comprising extracting vapors produced during the mixing and, optionally with the addition of a fuel gas, burning the vapors in a burner at temperatures greater than 600° C.

17. The method as claimed in claim 16, further comprising subjecting the vapors to intermediate heating and/or subsequent dry dedusting while transmitting the vapors to the burner.

18. The method as claimed in claim 16, further comprising passing the vapors through a bulk material filter while transmitting the vapors to the burner.

19. The method as claimed in claim 18, further comprising using a sub-fraction of the mixed material and/or activated carbon and/or petroleum coke and/or coke breeze as the filtering medium.

20. The method as claimed in claim 16, further comprising feeding heat released in the burning to the first stage for indirect and/or direct heating.

21. The method as claimed in claim 1, further comprising adding fragments, which are produced in the operation of molding the moldings, to the mixture of heated mixed material and binder.

22. The method as claimed in claim 1, wherein fine-grained to medium-grained mixed material comprises at least partly substances or mixtures of substances that occur or are used in pig iron production or in steel production, the substances comprising coal, activated carbon, coke breeze, petroleum coke, additives, slurries, dusts, filter cakes or carbon-containing gasification media.

23. The method as claimed in claim 1, wherein the organic binder at least partly comprises coal tar or coal-tar pitch.

24. The method as claimed in claim 1, wherein the binder cures by heating, or cures by heating in conjunction with additives in the binder, wherein the curing occurs, in the second stage or in an optional treatment stage following on after the second stage, and then the cured binder and the material is optionally passed on subsequently for cooling.

25. The method as claimed in claim 1, wherein the mixed material has an average grain size of 1 mm.

26. The method as claimed in claim 16, wherein the vapors are burned at temperatures greater than 850° C.

* * * * *